US006399558B1

(12) United States Patent
Hazenkamp et al.

(10) Patent No.: US 6,399,558 B1
(45) Date of Patent: Jun. 4, 2002

(54) WASHING AND CLEANING PROCESS

(75) Inventors: Menno Hazenkamp, Basel (CH); Frank Bachmann, Freiburg; Cornelia Makowka, Laufenburg, both of (DE); Marie-Josée Dubs, Wittersdorf (FR); Grit Richter, Neuenburg (DE); Gunther Schlingloff, Riehen; Josef Dannacher, Basel, both of (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/914,741

(22) PCT Filed: Feb. 28, 2000

(86) PCT No.: PCT/EP00/01624

§ 371 (c)(1),
(2), (4) Date: Sep. 4, 2001

(87) PCT Pub. No.: WO00/53708

PCT Pub. Date: Sep. 14, 2000

(30) Foreign Application Priority Data

Mar. 8, 1999 (CH) ..... 0429/99

(51) Int. Cl.[7] ..... C11D 1/86; C11D 3/26; C11D 3/395; C11D 3/39

(52) U.S. Cl. ..... 510/312; 510/303; 510/313; 510/314; 510/351; 510/356; 510/357; 510/372; 510/376; 510/499; 8/111; 8/137

(58) Field of Search ..... 510/303, 312, 510/313, 314, 351, 356, 357, 372, 376, 309, 499; 8/111, 137

(56) References Cited

U.S. PATENT DOCUMENTS 5,733,341 A * 3/1998 Eckhardt et al. ..... 8/111
6,306,808 B1 * 10/2001 Hazenkamp et al. ..... 510/224

FOREIGN PATENT DOCUMENTS

| | | |
|---|---|---|
| DE | 19529905 | 2/1997 |
| EP | 693550 | 11/1998 |
| EP | 717103 | 11/1998 |
| EP | 902083 | 3/1999 |

* cited by examiner

*Primary Examiner*—Gregory Delcotto
(74) *Attorney, Agent, or Firm*—Kevin T. Mansfield

(57) ABSTRACT

A washing and cleaning process which comprises adding to the corresponding liquor comprising a peroxide-containing washing and cleaning agent 1 to 500 millimoles per liter of liquor of one or more than one compound of the salene type.

12 Claims, No Drawings

WASHING AND CLEANING PROCESS

The present invention relates to novel catalysts which significantly improve the bleaching effect of hydrogen peroxide in the treatment of textile material without causing any substantial damage to fibre and dyeings, and to washing and cleaning agent formulations comprising these catalysts as well as to a method for cleaning and/or bleaching substrates which uses such washing and cleaning agent formulations.

Peroxide-containing bleaches have been used for some time in washing and cleaning processes. At a liquor temperature of 90° C. or more they are highly effective. As the temperature drops, however, their performance decreases markedly. It is known that diverse transition metal ions, added in the form of suitable salts or co-ordination compounds containing such cations, catalyse the degradation of $H_2O_2$. In this way it is possible to increase the bleaching effect of $H_2O_2$, or of precursors releasing $H_2O_2$ and also of other peroxide compounds, which effect is insufficient at lower temperatures. Important in practice are in this case only those combinations of transition metal ions and ligands, the peroxide activation of which is also expressed in an enhanced readiness to oxidise with regard to the substrate and not only in a catalase-like disproportionation, for the latter activation, which is unwanted in the present case, can further diminish the bleaching effects of $H_2O_2$ and its derivatives, which are insufficient at low temperatures.

As regards bleaching-effective $H_2O_2$ activation, mono- and polynuclear variants of manganese complexes with diverse ligands, in particular with 1,4,7-trimethyl-1,4,7-triazazyclononane and, optionally, oxygen-containing bridging ligands, are held to be particularly effective at present. Such catalysts are sufficiently stable under practice conditions and contain the ecologically safe metal cation $Mn^{(n+)}$. However, their use entails substantial damage to dyes and fibres. The catalysts of this invention, however, are capable of significantly increasing the bleaching effect of $H_2O_2$ without causing any substantial damage to the washing goods.

Accordingly, this invention relates to a washing and cleaning process, which comprises adding to the liquor comprising a peroxide-containing washing and cleaning agent 1–500 $\mu$mol per litre of liquor of a compound of formula (1)

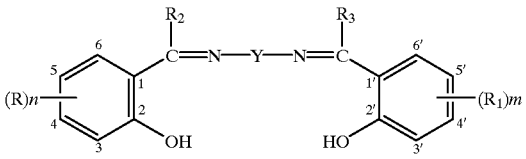

or (2)

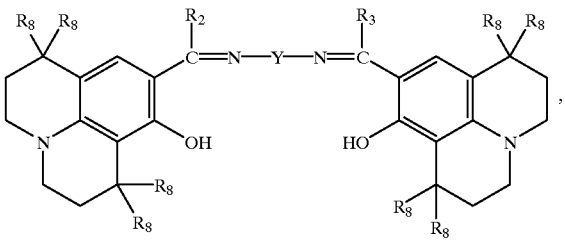

wherein n is 0, 1, 2 or 3, m is 1, 2 or 3, $R_4$ is hydrogen or linear or branched $C_1$—$C_4$alkyl, $R_8$ is hydrogen or linear or branched $C_1$—$C_4$alkyl, Y is a linear or branched alkylene radical of formula —$[C(R_4)_2]_r$—, wherein r is an integer from 1 to 8, and the $R_4$ groups have each independently of one another the meaning given above;

—CX=CX—, wherein X is cyano, linear or branched $C_1$–$C_8$alkyl or di(linear or branched $C_1$–$C_8$alkyl) amino, —$(CH_2)_q$—$NR_4$—$(CH_2)_q$—, wherein $R_4$ has the meaning cited above, and q is 1, 2, 3 or 4; or a 1,2-cyclohexylene radical of formula:

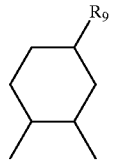

or a 1,2-aryl radical of formula

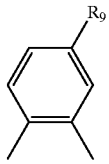

, wherein $R_9$ is hydrogen, $SO_3H$, $CH_2OH$ or $CH_2NH_2$,

R and $R_1$ are each independently of the other cyano, halogen, $OR_4$ or $COOR_4$, wherein $R_4$ has the meaning cited above, nitro, linear or branched $C_1$–$C_8$alkyl, linear or branched partially fluorinated or perfluorinated $C_1$–$C_8$alkyl, $NR_5R_6$, wherein $R_5$ and $R_6$ are identical or different and are each hydrogen or linear or branched $C_1$–$C_{12}$alkyl, or linear or branched $C_1$–$C_8$alkyl-$R_7$, wherein $R_7$ is $NH_2$, $OR_4$, $COOR_4$ or $NR_5R_6$, which have the meanings given above, or —$CH_2$—$N\oplus R_4R_6R_7$ or —$N\oplus R_4R_5R_6$, wherein $R_4$, $R_5$ and $R_6$ have the meanings cited above, $R_2$ and $R_3$ are each independently of the other hydrogen, linear or branched $C_1$–$C_4$alkyl or unsubstituted aryl, or aryl which is substituted by cyano, halogen, $OR_4$ or $COOR_4$, wherein $R_4$ is hydrogen or linear or branched $C_1$–$C_4$alkyl, by nitro, linear or branched $C_1$–$C_8$alkyl, $NHR_5$ or $NR_5R_6$, wherein $R_5$ and $R_6$ are identical or different and are each hydrogen or linear or branched $C_1$–$C_{12}$alkyl, or by linear or branched $C_1$–$C_8$alkyl-$R_7$, wherein $R_7$ is $NH_2$, $OR_4$, $COOR_4$ or $NR_5R_6$, which have the meanings given above, or by —$N\oplus R_4R_5R_6$, wherein $R_4$, $R_5$ and $R_6$ have the meanings given above.

It is preferred to add 5 to 350 $\mu$mol, preferably 10 to 250 $\mu$mol, per litre of washing liquor, of a compound of formula (1) or (2) to the washing and cleaning liquor.

If, in the compounds of formula (1), R and/or $R_1$ is —$N\oplus R_4R_5R_6$, or $R_2$ and/or $R_3$ are —$N\oplus R_4R_5R_6$-substituted aryl, wherein $R_4$, $R_5$ and $R_6$ have the meanings cited above, then suitable anions for balancing the positive charge at the —$N\oplus R_4R_5R_6$ group are halides, such as chloride, bromide and iodide, perchlorate, sulfate, nitrate, hydroxide, $BF_4^-$, $PF_6^-$, carboxy-late, acetate, tosylate or triflat. Bromide, chloride and iodide are preferred.

In those compounds of formula (1) wherein n is 2 or 3, the R groups may have the same or different meanings. The same applies to compounds of formula (1), where m is 2 or 3, with respect to the $R_1$ groups.

Y defined as a 1,2-cyclohexylene radical may be in any of its stereoisomeric cis/trans forms.

Y is preferably a radical of formula $—(CH_2)_r—$, wherein r is an integer from 1 to 8, or of formula $—C(R_4)_2—(CH_2)_p—C(R_4)_2—$, wherein p is a number from 0 to 6, preferably from 0 to 3, and the $R_4$ groups are each independently of one another hydrogen or $C_1$–$C_4$alkyl, preferably hydrogen or methyl, or a 1,2-cyclohexylene radical or a 1,2-phenylene radical of formula:

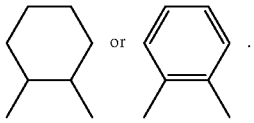

Halogen is preferably chloro, bromo or fluoro. Chloro is particularly preferred.

If n or m is 1, the R and $R_1$ groups are preferably in 4-position of the respective benzene ring unless R or $R_1$ is nitro or $COOR_4$. In that case the R or $R_1$ group is preferably in 5-position. If R or $R_1$ is $N\oplus R_4R_5R_6$, the R or $R_1$ group is preferably in 4- or 5-position.

If n or m is 2, the two R or $R_1$ groups are preferably in 4,6-position of the respective benzene ring unless R or $R_1$ is nitro or $COOR_5$. In that case, the R or $R_1$ groups are preferably in 3,5-position.

If R or $R_1$ is di($C_1$–$C_{12}$alkyl)amino, then the alkyl group may be straight-chain or branched. The alkyl group preferably contains 1 to 8, more preferably 1 to 3, carbon atoms.

R and $R_1$ are preferably hydrogen, $OR_4$, $COOR_4$, $N(R_4)_2$ or $N\oplus(R_4)_3$, wherein in $N(R_4)_2$ or $N\oplus(R_4)_3$ the $R_4$ groups may be different and are hydrogen or $C_1$–$C_4$alkyl, preferably methyl, ethyl or isopropyl.

$R_2$ and $R_3$ are preferably hydrogen, methyl, ethyl or unsubstituted phenyl.

In particularly preferred compounds of formula (2) $R_8$ is hydrogen.

Aryl is typically naphthyl or, preferably, phenyl.

Particularly interesting compounds for use in the novel process are those of formulae (1a)

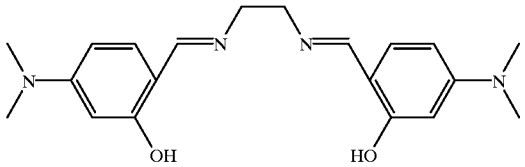

(1b)

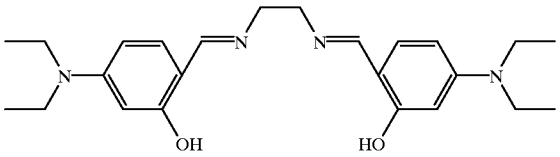

-continued (1c)

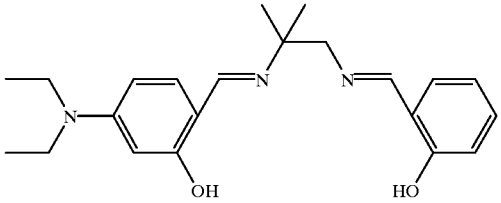

(1d)

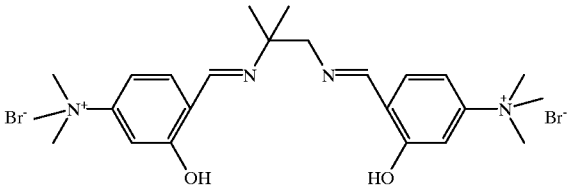

(1e)

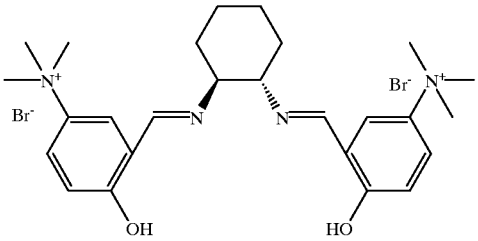

(1f)

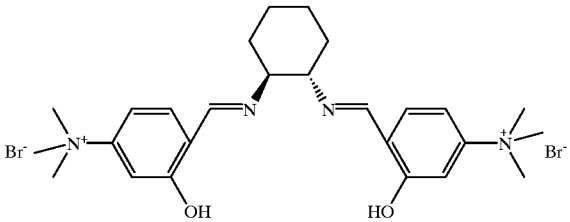

(1g)

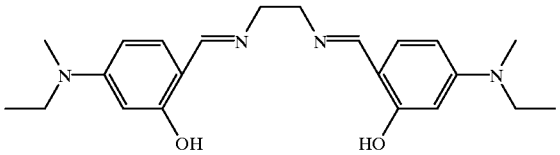

(1h)

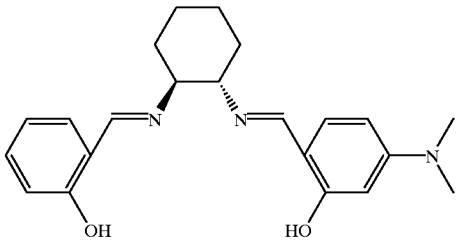

-continued (1i)

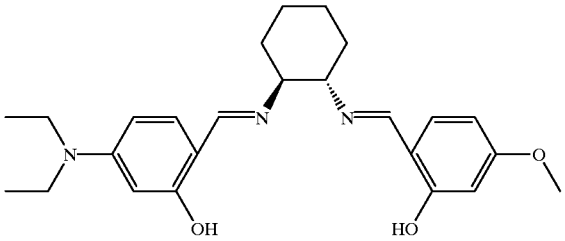

(1j)

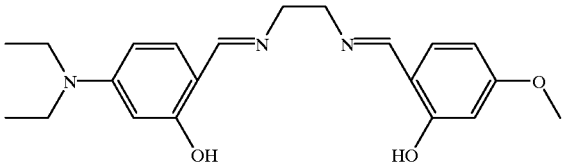

(1k)

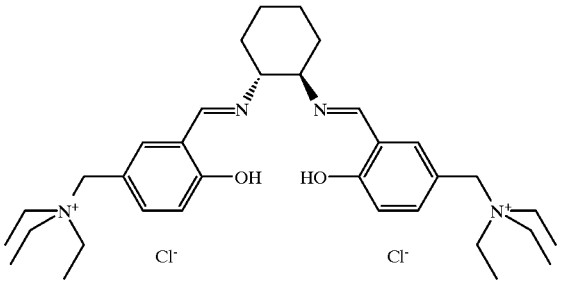

(1l)

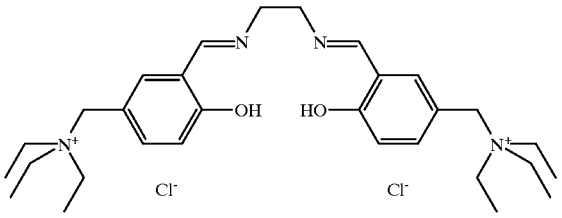

(1m)

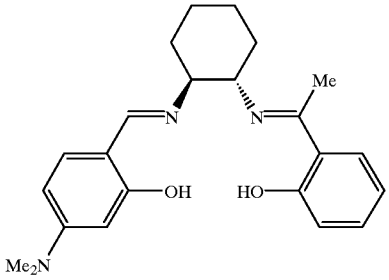

-continued (1n)

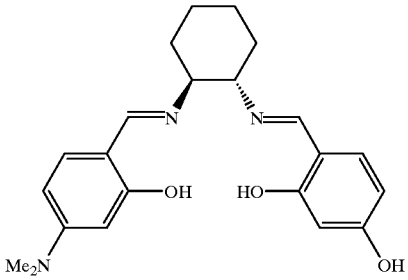

(1o)

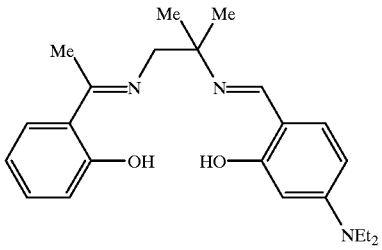

(1p)

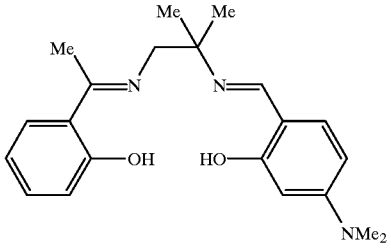

The compounds of formula (1) and (2) are known or can be prepared in a manner known per se. General methods of preparation are described, inter alia, in U.S. Pat. No. 5,281,578 and by Bernardo et al. in Inorg. Chem. 35 (1996) 387.

The compounds of formula (1) or (2) can be used singly or in admixture with two or more compounds of formula (1) or (2).

It is also possible to use the compounds of formula (1) or (2) together with transition metal salts or complexes, for example with compounds or salts of manganese, iron, cobalt or copper. Suitable are, for example, the salene complexes which are disclosed in the European patent applications No. 98810870.0 and 98810289.3.

This invention also relates to a washing and cleaning agent, which comprises

I) 5–90%, preferably 5–70%, A) of an anionic surfactant and/or B) of a nonionic surfactant, II) 5–70%, preferably 5–50%, more preferably 5–40%, C) of a builder substance, III) 0.1–30%, preferably 1–12%, D) of a peroxide, and IV) a compound of formula (1) or (2) in an amount which in the washing or cleaning process results in a 1–500

μmolar, preferably 5–350 μmolar, more preferably 10–250 μmolar, solution.

The washing and cleaning agent can be in solid or liquid form, for example in the form of a liquid non-aqueous agent, containing not more than 5% by weight, preferably 0 to 1% by weight, of water, and as basis a suspension of a builder substance in a nonionic surfactant, as is described, inter alia, in GB-A-2,158,454.

However, the washing and cleaning agent is preferably in powdered or granulated form which may be produced, for example, by first preparing a starting powder by spray-drying an aqueous slurry, containing all of the above components except the components D) and E), and then adding the dry components D) and E) and mixing all of the components. It is also possible to add the component E) to an aqueous slurry containing the components A), B) and C) and, after spray-drying this mixture, mixing the component D) with the dry mixture.

It is also possible to start from an aqueous slurry which contains the components A) and C), but not, or only partially, component B). After spray-drying the slurry, the component E) is mixed with the component B) and added thereto, and the component D) is then admixed in dry form.

The anionic surfactant A) may be, for example, a sulfate, sulfonate or carboxylate surfactant, or a mixture thereof. Preferred sulfates are those which contain 12–22 carbon atoms in the alkyl radical, optionally in combination with alkylethoxysulfates, the alkyl radical of which contains 10–20 carbon atoms.

Preferred sulfonates are, for example, alkylbenzenesulfonates containing 9–15 carbon atoms in the alkyl radical. The cation in the anionic surfactants is preferably an alkali metal cation, more preferably sodium.

Preferred carboxylates are alkali metal sarcosinates of formula $R—CO—N(R^1)—CH_2COOM^1$, wherein R is alkyl or alkenyl containing 8 –18 carbon atoms in the alkyl or alkenyl radical, $R^1$ is $C_1$–$C_4$alkyl, and $M^1$ is an alkali metal.

The nonionic surfactant B) may be, for example, a condensate of 3–8 mol of ethylene oxide with 1 mol of primary alcohol containing 9–15 carbon atoms.

Suitable builder substances C) are, for example, alkali metal phosphates, preferably tripolyphosphates, carbonates or bicarbonates, more preferably their sodium salts, silicates, aluminium silicates, polycarboxylates, polycarboxylic acids, organic phosphonates, aminoalkylenepoly (alkylenephosphonates), or mixtures of these compounds.

Particularly suitable silicates are the sodium salts of crystalline sheet silicates of formula $NaHSi_tO_{2t+1}.pH_2O$ or $Na_2Si_tO_{2t+1}.pH_2O$, wherein t is a number from 1.9 to 4, and p is a number from 0 to 20.

Preferred aluminium silicates are those which are commercially available under the names Zeolite A, B, X and HS as well as mixtures containing two or more of these components.

Preferred polycarboxylates are the polyhydroxycarboxylates, in particular citrates, and acrylates as well as their copolymers with maleic anhydride. Preferred polycarboxylic acids are nitrilotriacetic acid, ethylenediaminetetracetic acid, ethylenediaminedisuccinate both in racemic form and in (S,S)-form.

Particularly suitable phosphonates or aminoalkylenepoly (alkylenephosphonates) are the alkali metal salts of 1-hydroxyethane-1,1-diphosphonic acid, nitrilotris (methylenephosphonic acid), ethylenediaminetetramethylenephosphonic acid and diethylenetriaminepentamethylenephosphonic acid.

Suitable peroxide components D) are, for example, the organic and inorganic peroxides known in the literature and available on the market, which bleach textile materials at the standard washing temperatures, for example from 10 to 95° C. The organic peroxides are, for example, mono- or polyperoxides, preferably organic peracids or the salts thereof, such as phthalimidoperoxycapronic acid, peroxybenzoic acid, diperoxy dodecane diacid, diperoxynonane diacid, diperoxydecane diacid, diperoxyphthalic acid or the salts thereof.

However, it is preferred to use inorganic peroxides, such as persulfates, perborates, percarbonates or persilicates. It is of course also possible to use mixtures of inorganic and/or organic peroxides. The peroxides can be in different crystal forms and may have different water contents, and they may also be used together with other inorganic or organic compounds in order to improve their storage stability.

The peroxides are preferably added to the washing and cleaning agent by mixing the components, for example by means of a screw feeding system and/or a fluidised bed mixer.

In addition to the novel combination, the washing and cleaning agents may contain one or more than one fluorescent whitening agent, for example from the class of the bis-triazinylaminostilbenedisulfonic acid, bis-triazolylstilbenedisulfonic acid, bis-styrylbiphenyl or bis-benzofuranylbiphenyl, a bis-benzoxalyl derivative, bis-benzimidazolyl derivative, a coumarine derivative or a pyrazoline derivative.

The washing and cleaning agents may also contain suspending agents for dirt, for example sodium carboxymethylcellulose, pH-regulators, e.g. alkali or alkaline earth metal silicates, foam regulators, e.g. soaps, salts for regulating the spray-drying and the granulation properties, e.g. sodium sulfate, fragrances and, optionally, antistatic agents and softe ners, enzymes such as amylase, bleaching agents, bleaching activators such as TAED (tetraacetylethylenediamine) or SNOBS (sodium nonanoyloxybenzene sulfonate), pigments and/or shading agents. These components must, of course, be stable against the bleaching agent used.

Other additives preferably added to the novel washing and cleaning agents are polymers which prevent staining during the washing of the textiles through dyes that are present in the liquor and that have separated from the textiles under the washing conditions. These additives are preferably polyvinylpyrrolidones which are unmodified or modified through the incorporation of anionic or cationic substituents, in particular those having a molecular weight in the range from 5'000 to 60'000, preferably from 10'000 to 50'000. These polymers are preferably used in an amount from 0.05 to 5% by weight, preferably from 0.2 to 1.7% by weight, based on the entire weight of the washing agent.

The following non-limitative Examples illustrate the invention in more detail. Parts and percentages are by weight, unless otherwise stated.

EXAMPLE 1

The bleaching tests are carried out as follows: 7.5 g of a white cotton fabric and 2.5 g of a cotton fabric stained with tea, red wine or blackberries are treated in 80 ml of a washing liquor. This liquor comprises the standard washing agent ECE phosphate-free (456 IEC) EMPA, Switzerland, in a concentration of 7.5 g/l and the oxidants, catalysts and, optionally, activators in the concentrations listed in the corresponding Tables. The washing process is carried out in a steel beaker in a LINITEST apparatus over 30 minutes at 40° C. To evaluate the bleaching results, the increase in brightness DY (difference in brightness according to CIE) resulting from the treatment of the stainings is used. Table 1 contains the DY values for all 3 stainings on cotton after treatment with the systems a) to n).

TABLE 1

| Cotton staining with | Increase of brightness DY at 40° C. in the system* | | | | | | | | | | | | | |
|---|---|---|---|---|---|---|---|---|---|---|---|---|---|---|
| | a) | b) | c) | d) | e) | f) | g) | h) | i) | j) | k) | l) | m) | n) |
| tea | 0 | 18 | 27 | 25 | 24 | 21 | 24 | 21 | 23 | 23 | 25 | 25 | 24 | 23 |
| red wine | 3 | 11 | 22 | 23 | 21 | 17 | 22 | 15 | 18 | 16 | 19 | 22 | 20 | 20 |
| blackberries | 8 | 20 | 31 | 22 | 21 | 22 | 27 | 22 | 23 | 23 | 21 | 26 | 21 | 20 |

*a) Washing liquor without bleaching system. B) Washing liquor with 8.6 mmol/l of $H_2O_2$. c) Washing liquor with 1.125 g/l of sodium perborate monohydrate and 0.3 g/l of TAED. d) Washing liquor with 8.6 mmol/l of $H_2O_2$ and 5 $\mu$mol/l of catalyst A. e) Washing liquor with 8.6 mmol/l of $H_2O_2$ and 100 $\mu$mol/l of catalyst 1a. f) to n) Idem, but with the catalysts 1b to 1j Catalyst A:

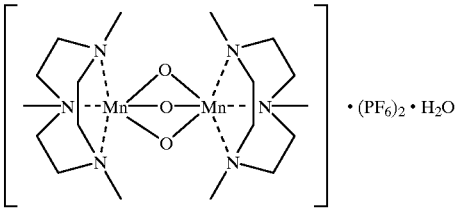

EXAMPLE 2

The bleaching effect of the novel catalysts is also tested at 20° C. The tests and the evaluation of the bleaching results are carried out similarly to the procedure of Example 1. Table 2 contains the DY values for the tea stainings on cotton after treatment with the systems a) to n).

TABLE 2

| Cotton staining with | Increase of brightness DY at 20° C. in the system* | | | | | | | | | | | | | |
|---|---|---|---|---|---|---|---|---|---|---|---|---|---|---|
| | a) | b) | c) | d) | e) | f) | g) | h) | i) | j) | k) | l) | m) | n) |
| tea | 0 | 5 | 16 | 21 | 14 | 3 | 15 | 16 | 21 | 16 | 10 | 18 | 13 | 16 |

*a) Washing liquor without bleaching system. B) Washing liquor with 8.6 mmol/l of $H_2O_2$. c) Washing liquor with 1.125 g/l of sodium perborate monohydrate and 0.3 g/l of TAED. d) Washing liquor with 8.6 mmol/l of $H_2O_2$ and 5 $\mu$mol/l of catalyst A. e) Washing liquor with 8.6 mmol/l of $H_2O_2$ and 100 $\mu$mol/l of catalyst 1a. f) to n) Idem, but with the catalysts 1b to 1j

EXAMPLE 3

Use of the novel catalysts causes hardly any additional bleaching of the dyes in dyed cotton washing goods. When used as described above, on average almost the same relative dye losses are obtained after 5 treatments—even in the case of dyes known to be very sensitive—as in the bleach-free system. The values in Table 3 are relative dye losses in percent, determined on the basis of Kubelka-Munk values in the respective absorption maximum.

TABLE 3

| Cotton staining with dye | Relative decrease (%) in the system* | | | | | | | | | | | | | |
|---|---|---|---|---|---|---|---|---|---|---|---|---|---|---|
| | a) | b) | c) | d) | e) | f) | g) | h) | i) | j) | k) | l) | m) | n) |
| Vat Blue 4 | 10 | 10 | 5 | 20 | 35 | 5 | 5 | 5 | 5 | 15 | 30 | 10 | 15 | 25 |
| Reactive Brown 17 | 10 | 20 | 15 | 45 | 15 | 5 | 15 | 15 | 10 | 15 | 15 | 10 | 15 | 15 |
| Reactive Black 5 | 10 | 10 | 30 | 45 | 15 | 10 | 10 | 10 | 10 | 10 | 15 | 10 | 10 | 10 |
| Vat Brown 1 | 5 | 0 | 0 | 0 | 5 | 0 | 0 | 5 | 5 | 5 | 0 | 0 | 0 | 0 |
| Reactive Red 123 | 10 | 15 | 15 | 40 | 5 | 5 | 5 | 10 | 5 | 10 | 10 | 5 | 5 | 5 |
| Direct Blue 85 | 20 | 20 | 15 | 15 | 20 | 20 | 15 | 20 | 20 | 25 | 15 | 15 | 10 | 15 |

*a) to n) as in Table 1.

EXAMPLE 4

The novel catalysts are used in an extremely fibre-preserving manner. When used as described above, the same relative decreases in the average degree of polymerisation are found after five treatments—even in the case of cotton dyeings known to be highly susceptible to fibre damage—as in the bleach-free system, see Table 4.

TABLE 4

| Cotton dyeing with | Relative decrease (%) in the system* | | | | |
|---|---|---|---|---|---|
| dye | a) | b) | c) | d) | e) |
| Vat Blue 4 | 5 | 5 | 5 | 40 | 5 |
| Reactive Brown 17 | 0 | 0 | 5 | 50 | 0 |
| Reactive Black 5 | 0 | 0 | 0 | 20 | 0 |
| Vat Brown 1 | 10 | 5 | 20 | 55 | 5 |
| Reactive Red 123 | 5 | 0 | 5 | 40 | 5 |
| Direct Blue 85 | 10 | 5 | 0 | 5 | 10 |

*a) to d) as in Table 1. e) Washing liquor with 8.6 mmol/l $H_2O_2$ and 200 μmol/l of catalyst 1b.

EXAMPLE 5

Preparation of (1e)

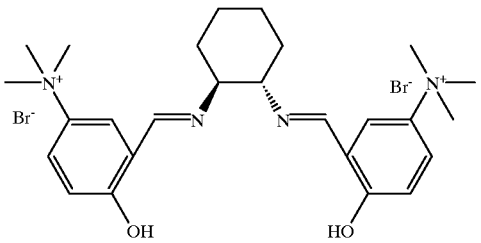

A suspension of 500 mg (1.92 mmol) of 3-formyl-4-hydroxyphenyltrimethylammonium bromide [synthesis instruction M. Ando, S. Emoto, Bull. Chem. Soc. Jpn, Vol.51 (8) 2433 (1978)] in 2 ml ethanol is charged dropwise at 50° C. with 105 mg (0.915 mmol) of trans-1,2-diaminocyclohexane. The reaction mixture is kept at 80° C. for 4 h. After cooling to room temperature, the resulting precipitate is collected by filtration, washed with a small amount of cold ethanol and dried under a high vacuum at 40° C. until the mass is constant. Yield: 435 mg (79%) of a yellowish solid.

$^{13}$C NMR (DMSO-$d_6$) δ=19.8, 25.5 27.4, 29.2 (cycl. $CH_2$), 53.4 ($NCH_3$), 63.6 ($CH_2$—<u>C</u>H) 118.7, 121.9, 123.1 (tert aryl-C), 111.4, 131.5, 172.4 (quart. aryl-C), 163.2 (C═N).

EXAMPLE 6

Preparation of (1f)

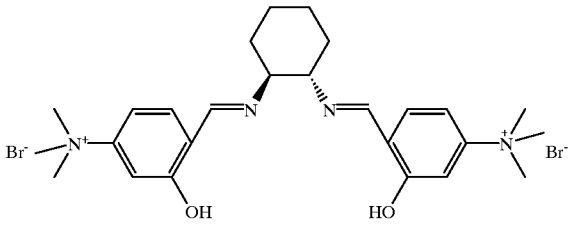

The synthesis and working up are carded out as in Example 5, starting from 500 mg (1.92 mmol) of 4-formyl-3-hydroxyphenyltrimethylammonium bromide and 0.105 g (0.915 mmol) of trans-1,2-diaminocylohexane. Yield: 299 mg (55%).

$^{13}$C NMR ($D_2O$) δ=23.6, 29.5, 31.3, 33.1 (cycl. $CH_2$), 56.8 ($NCH_3$), 67.3 ($CH_2$—<u>C</u>H), 107.5, 112.0, 136.1 (tert aryl-C), 117.3, 152.4, 170.9 (quart. aryl-C), 166.6 (C═N).

EXAMPLE 7

Preparation of (1g)

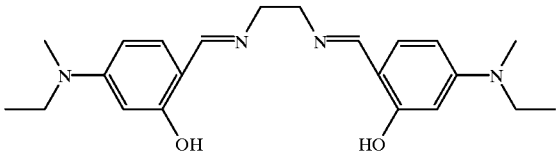

A solution of 500 mg (2.79 mmol) of 4-(N-ethyl-N-methylamino)salicylaldehyde is charged dropwise at room temperature with a solution of 80 mg (1.33 mmol) of ethylenediamine, and this reaction solution is warmed for 4 h to 70° C. After cooling to room temperature, the resulting precipitate is collected by filtration, washed with a small amount of cold ethanol and dried in a vacuum drying oven at 30° C. Yield: 476 mg (94%).

$^1$H NMR ($CDCl_3$) δ=1.13 (m, 6H, C<u>H</u>$_3$—$CH_2$), 2.92 (s, 6H, $NCH_3$), 3.38 (m, 4H, $CH_3$—C<u>H</u>$_2$), 3.76 (s, 4H, $NCH_2$), 6.12 (m, 4H, aryl-H), 6.98 (m, 2H, aryl-H), 8.08 (s, 2H, C<u>H</u>═N), 13.52 (s, br, 2H, OH).

$^{13}$C NMR ($CDCl_3$) δ=11.7 (<u>C</u>H$_3$—$CH_2$), 37.4 ($NCH_3$), 46.6 ($CH_3$—<u>C</u>H$_2$), 58.4 ($NCH_2$), 68.8 (N<u>C</u>H$_2$), 98.6, 103.3, 132.8 (tert aryl-C), 108.6, 152.6, 165.4 (quart. aryl-C), 164.6 (C═N).

EXAMPLE 8

Preparation of (1d)

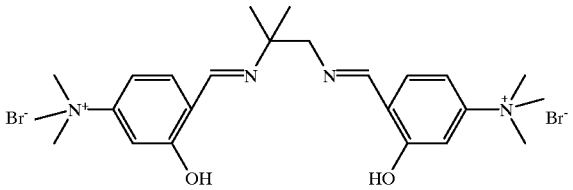

The preparation is carried out in analogy to Example 6, but replacing 1,2-diaminocyclohexane with an equivalent amount of 1,2-diamino-2-methylpropane.

EXAMPLE 9

Preparation of (1c')

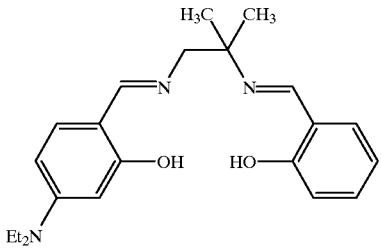

and (1c)

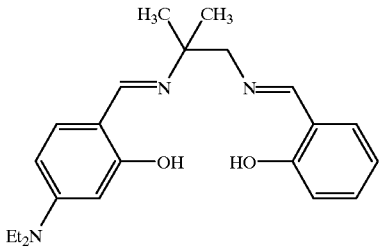

A solution of 4.56 g (0.0517 mol) of 1,2-diamino-2-methylpropane in 50 ml of ethanol is placed in a vessel. With stirring, a solution of 10.0 g (0.0517 mol) of 4-diethylamino-2-hydroxybenzaldehyde in 50 ml of ethanol is added dropwise at room temperature over 2 h. After stirring for 2 h (DC control acetonitrile/water 9:1), the reaction is complete. The reaction solution is carefully concentrated and dried under a high vacuum. The crude product obtained is 13.6 g of 2-[(2-amino-2-methylpropylimino)-methyl-5-diethylaminophenol in the form of a dark red oil which is then further used without any additional purification.

A solution of 13.6 g (0.0517 mol) of 2-[(2-amino-2-methylpropylimino)-methyl-5-diethylaminophenol in 50 ml of ethanol is heated to 50° C. and then 5.5 ml (6.31 g, 0.0517 mol) of salicylaldehyde are added dropwise over three minutes. The temperature of the solution rises by 5° C. After refluxing the reaction solution for three hours, it is allowed to cool and is then concentrated by evaporation. This yields 19.31 g of crude mixture which contains the two diastereomers (1c') and (1c). The crude mixture is separated by column chromatography (ethyl acetate/methanol 9:1). Yield: 4.01 g (21%) (1c') of a pale beige solid, 1.55 g (8%) (1c) of a pale brown oil. NMR data (1c'):

$^{13}$C NMR ($CD_3OD$): δ=12.2 ($\underline{C}H_3CH_2N$), 23.9 ($\underline{C}H_3)_2C$), 44.5 ($N\underline{C}H_2CH_3$), 60.1 (quart. $\underline{C}(CH_3)_2$), 62.0 (=$N\underline{C}H_2$), 99.4, 104.3, 117.0, 118.6, 132.4, 132.8, 135.6 (tert aryl-C), 108.3, 119.1, 155.2, 162.2 (quart aryl-C), 162.8, 163.5 (C=N). NMR data (1c):

$^{13}$C NMR ($CD_3OD$): δ=12.2 ($\underline{C}H_3CH_2N$), 24.7 ($\underline{C}H_3)_2C$—), 44.5 ($N\underline{C}H_2CH_3$), 57.1 (quart. $\underline{C}(CH_3)_2$), 69.3 (=$NCH_2$), 99.6, 104.1, 116.8, 118.9, 132.2, 132.8, 135.9 (tert aryl-C), 108.1, 119.1, 155.4, 161.4, 177.0 (quart aryl-C), 158.0, 168.4 (C=N).

EXAMPLE 10

Preparation of (1h)

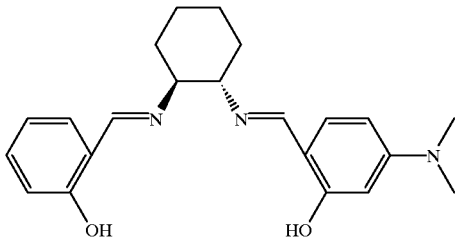

0.5 g (2.29 mmol) of 2-(2-aminocyclohexylimino) methylphenol, prepared according to *Tetrahedron Letters* 39 (1998) 4199–4202, is dissolved in 50 ml of ethanol until a clear yellow solution is obtained. 378 mg (2.29 mmol) of 4-dimethylaminosalicylaldehyde, dissolved in 50 ml of ethanol, are added dropwise at room temperature. After heating the reaction solution for 4 h to 60° C., it is allowed to cool to room temperature and is then carefully concentrated in a rotary evaporator, yielding 829 mg of a yellow solid. This crude product is purified by separation via column chromatography (silica gel, ethyl acetate/methanol 9:1. Yield: 318 mg (38%) of a pale yellow solid.

$^{13}$C NMR ($CDCl_3$): δ=24.2, 24.4, 33.2, (cycl.—$CH_2$), 40.0 (N—$CH_3$), 71.1, 72.9 (tert cycl. CH). 98.7, 103.4, 116.7, 118.5, 131.5, 132.0, 132.6 (tert aryl-C), 108.7, 118.7, 153.6, 161.1 (quart. aryl-C), 163.2, 164.7 (C=N).

EXAMPLE 11

Preparation of (1i)

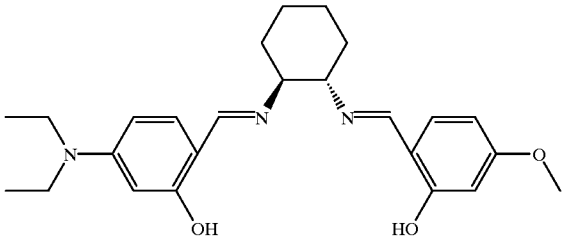

A suspension of 2.5 g (8.64 mmol) of 2-[(2-aminocyclohexylimino)methyl]-5-diethylaminophenol in 200 ml of ethanol is charged dropwise with a solution of 1.3 g (8.64 mmol) of 4-methoxysalicylaldehyde in 200 ml of ethanol over 45 minutes at room temperature. This reaction solution is heated for 4 h to 60° C. After cooling the reaction solution to room temperature, it is concentrated to dryness. The crude product obtained is purified by column chromatography (ethyl acetate/methanol 9:1). Yield: 500 mg (14%) of a reddish orange oil which slowly crystallises.

$^{13}$ C NMR ($CDCl_3$): δ=12.7 ($\underline{C}H_3CH_2N$), 24.3, 33.2 (cycl.—$CH_2$), 44.4 ($CH_3\underline{C}H_2N$), 55.3 ($OCH_3$), 70.9, 71.5, 71.6 (tert cycl. CH), 98.0, 101.1, 103.0, 106.1, 106.2, 132.9 (tert aryl-C), 108.2, 112.3, 151.3, 165.5 (quart. aryl-C), 162.9, 163.7 (C=N).

EXAMPLE 12

Preparation of (1j)

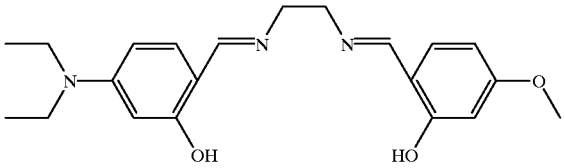

A solution of 3.87 g (0.0644 mol) of ethylenediamine in 300 ml of ethanol is placed in a vessel and then a solution of 12.45 9 (0.0644 mol) of 4-diethylaminosalicylaldehyde in 60 ml of ethanol is slowly added dropwise, with stirring, at room temperature. The solution is refluxed for 2 h. After cooling to room temperature, a solution consisting of 9.8 g (0.0644 mol) of 4-methoxysalicylaldehyde in 25 ml ethanol is slowly added dropwise and the reaction solution is then heated for 1 h to reflux temperature. The reaction solution is allowed to cool slowly and is stirred for 8 h at room temperature. For working up, the resulting yellow suspension is concentrated under vacuum and purified by column chromatography over silica gel (eluant ethyl acetate/methanol 9:1). The asymmetric ligand is isolated in the form of an orange oil. Yield: 4.00 g (17%). $^{13}C$ NMR ($CDCl_3$): δ=12.7 ($\underline{C}H_3CH_2N$), 44.4 ($N\underline{C}H_2CH_3$), 55.3 ($OCH_3$), 58.1, 58.7 ($N\underline{C}H_2$), 98.0, 101.2, 103.1, 106.3, 132.9, 133.0 (tert aryl-C), 108.3, 112.3, 151.5, 163.5 (quart. aryl-C), 164.5, 165.4 (C═N).

EXAMPLE 13

Preparation of (R,R)-N,N'-bis(5-(triethylammoniomethylsalicylidene)-1,2-cyclohexanediamine dihydrochloride (1k)

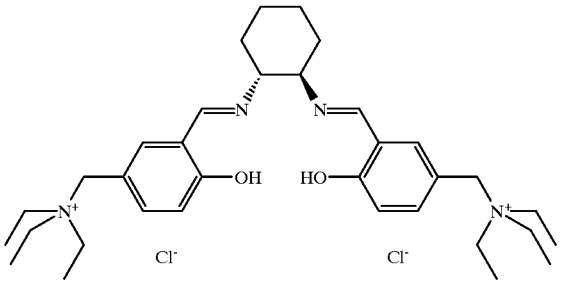

1.09 g (4 mmol) of (5-triethylammoniomethyl) salicylaldehyde chloride (synthesis see T. Tanaka et al., *Bull. Chem. Soc. Jpn.* 1997, 70, 615–629) is dissolved in 10 ml of water and charged with 0.228 g (2 mmol) of 1,2-diaminocyclohexane, dissolved in 2 ml of water. The yellow solution is stirred for 2 h at room temperature and is then concentrated in a rotary evaporator at a bath temperature of 60° C. (10 mbar). 2×50 ml of tetrahydrofuran are added and the mixture is again concentrated, yielding 1.22 g of the desired product in the form of yellow crystals in >90% purity (NMR).

$^{13}C$ NMR ($D_2O$): δ=7.4 ($CH_3$), 23.8, 31.3, 52.3, 59.6 (aliph. $CH_2$), 67.7 (tert C), 115.0, 116.5 (quart. aryl-C), 121.5, 138.5, 139.4 (tert aryl-C), 166.9 (C═N), 171.5 (quart. aryl-C).

EXAMPLE 14

Preparation of N,N'-bis(5-(triethylammoniomethyisalicylidene)-1,2-ethandiamine dihydrochloride (1l)

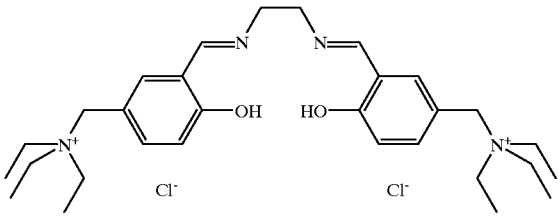

The compound is prepared in analogy to the instructions of the preceding Example. This yields yellow crystals in >90% purity (NMR).

$^{13}C$ NMR ($D_2O$) δ=7.4 ($CH_3$), 52.2, 53.5, 59.6 (aliph. $CH_2$ in each case), 114.6, 116.4 (quart. aryl-C), 120.5, 138.9, 139.6 (tert aryl-C), 168.7 (C═N), 172.3 (quart. aryl-C).

EXAMPLE 15

Preparation of (R,R)-N-[4-(dimethylamino) salicylaldehyde]-N'-(2-hydroxyacetophenone)-1,2-cyclohexanediimine (1m)

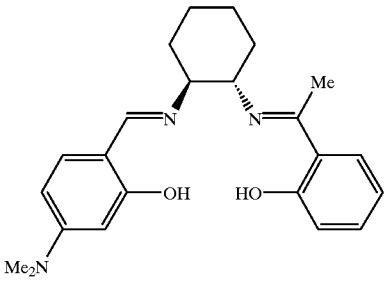

A solution of 2.5 g (9.56 mmol) of R,R-mono[4-N-(dimethylamino)salicylidene-1,2-cyclohexanediamine in 225 ml of ethanol is charged dropwise with 1.30 g (9.56 mmol) of 2-hydroxyacetophenone, dissolved in 225 ml of ethanol. This mixture is heated for 8 hours to 60° C. The resulting reddish brown clear solution is stirred for another 4 hours at room temperature and concentrated under high vacuum, yielding a crude product (3.6 g, dark red oil) which is purified by column chromatography (eluant ethyl acetate/methanol 9:1). Yield: 1.60 g (44%) of a reddish orange solid, m.p. 129° C.

$^{13}C$ NMR ($CDCl_3$): δ=14.7 ($CH_3$), 24.2, 24.3, 32.4, 33.2 (cycl. $CH_2$), 40.0 ($NCH_3$), 62.3, 72.2 (tert cycl. CH), 98.6, 103.4, 116.8, 118.6, 128.3, 132.3, 132.7 (tert aryl-C), 108.6, 119.1, 153.6, 164.3, 170.9 (quart. aryl-C), 163.2 ($\underline{C}$═N). $C_{23}H_{29}N_3O_2$ (379.5)

EXAMPLE 16

Preparation of (R,R)-N-[4-(dimethylamino)salicylidene]-N'-(4-hydroxysalicylidene)- 1,2-cyclohexanediamine (1n)

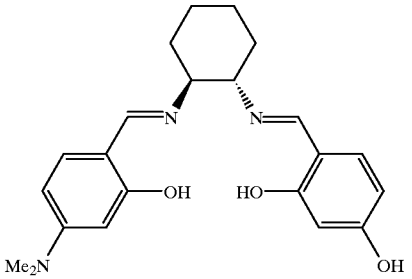

A solution of 2.5 g (9.56 mmol) of (R,R)-N-mono (4dimethylsalicylidene)-1,2-cyclohexanediamine in 225 ml of ethanol is charged dropwise with a solution of 1.321 g (9.56 mmol) of 2,4dihydroxybenzaldehyde in 225 ml of ethanol over 45 minutes at room temperature. The reaction solution is heated to 60° C. for 4 h. After cooling to room temperature, the resulting reddish brown clear solution is concentrated to dryness. The crude product (about 5 g) is separated by column chromatography (ethyl acetate/methanol 9:1). Yield: 1.09 g (30% of a yellowish orange solid), m.p. 202° C.

$^{13}$C NMR (DMSO-$d_6$): δ=23.7, 32.7, 32.8 (cycl.—$CH_2$), 40.0 ($NCH_3$), 70.3, 70.7 (tert cycl. CH), 97.9, 102.3, 103.2, 106.7, 132.5, 133.1 (tert aryl-C), 108.1, 111.1, 153.1, 161.4 (quart. aryl-C), 163.4, 163.9 (C═N). $C_{22}H_{27}N_3O_3$ (381.5)

EXAMPLE 17

Preparation of N-2-[4diethylamino)salicylidene]-N'-1-(2-hydroxyacetophenone)-2-methylpropane-1,2-diamine (1o)

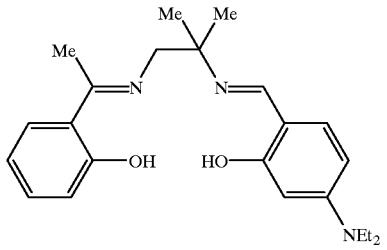

A solution of 500 mg (2.42 mmol) of N-1-mono(2-hydroxyacetophenone-2-methylpropane-1,2-diamine [prepared according to the literature instruction of H. Elias et al, Z. Naturforsch. 49b, 1089 (1994)] in 6 ml of methanol is charged with 478 mg (2.42 mmol) of 4-N-diethylaminosalicylaldehyde. The orange solution so obtained is heated for two hours to 80° C. After allowing the reaction solution to cool to room temperature it is concentrated and the residue is purified by column chromatography (eluant toluene/methanol 10:1). Yield: 442 mg (48%) of a yellowish oil.

$^{13}$C NMR ($CDCl_3$): δ=13.1 ($CH_3CH_2N$), 15.1 ($CH_3$), 26.0 ($(CH_3)_2C$), 44.9 ($CH_3CH_2N$), 59.1 (quart. $C(CH_3)_2$), 61.3 ($CH_2$), 98.8, 103.5, 117.5, 119.0 128.6 (tert aryl-C), 108.8, 119.7, 152.2, 164.2, 167.5 (quart. aryl-C), 159.6 (C═N), 173.0 ($(CH_3)C$═N).

EXAMPLE 18

Preparation of N-2-[4-dimethylamino)salicylidene]-N'-1-(2-hydroxyacetophenone)-2-methylpropane-1,2-diamine (1p)

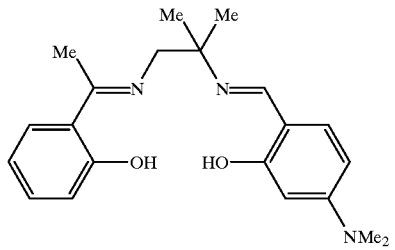

A solution of 500 mg (2.42 mmol) of N-1-mono(2-hydroxyacetophenone-2-methylpropane-1,2-diamine, prepared according to the literature reference given in the preceding Example, in 6 ml of methanol is charged with 400.3 mg (2.42 mmol) of 4-N-dimethylaminosalicylaldehyde. After stirring for 15 minutes at room temperature, the resulting yellow solution is heated for 1 hour to reflux temperature. After cooling, the reaction solution is concentrated under vacuum and the crude product obtained is purified by column chromatography (eluant ethyl acetate/methanol 11:1). Yield: 642 mg (75% of a yellow solid), melting point 115° C.

$^{13}$C NMR ($CDCl_3$): δ=13.5 ($CH_3$), 24.3 ($(CH_3)_2C$), 38.9 ($NCH_3$), 57.8 (quart. $C(CH_3)_2$), 59.7 ($CH_2$), 97.9, 102.3, 106.7, 115.9, 117.4, 127.0, 131.3, 131.9 (tert aryl-C), 107.8, 118.2, 152.8, 162.6, 165.1 (quart. aryl-C), 158.5 (C═N), 171.5 ($(CH_3)C$═N).

EXAMPLE 19

The following application data supplement Example 1. The washing conditions are the same as those given in Example 1:8.6 mmol/L of $H_2O_2$ and 100 μmol/L of catalyst.

| Cotton staining | Increase of brightness DY at 40° C. in the system with catalyst | | | | | |
|---|---|---|---|---|---|---|
| with | (1k) | (1l) | (1n) | (1m) | (1o) | (1p) |
| tea | 24 | 22 | 22 | 23 | 24 | 23 |

What is claimed is:

1. A washing and cleaning process, which comprises adding to a liquor comprising a peroxide-containing washing and cleaning agent, 1–500 μmol per litre of the liquor of a compound of the formula (1)

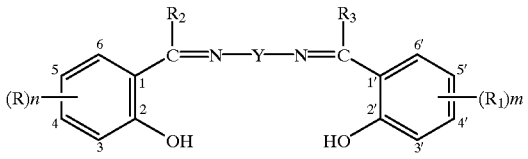

or

-continued (2)

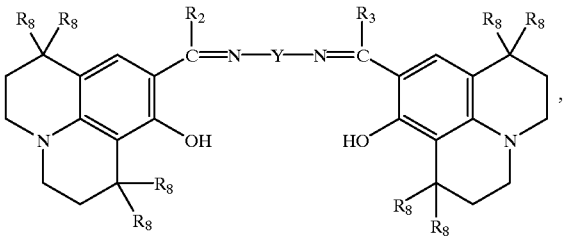

wherein n is 0, 1, 2or 3, m is 1, 2or 3, $R_4$ is hydrogen or linear or branched $C_1$–$C_4$alkyl, $R_8$ is hydrogen or linear or branched $C_1$–$C_4$alkyl, Y is a linear or branched alkylene radical of formula —$[C(R_4)_2]_r$—, wherein r is an integer from 1 to 8, and the $R_4$ groups have each independently of one another the meaning given above;

—CX═CX—, wherein X is cyano, linear or branched $C_1$–$C_8$alkyl or di(linear or branched $C_1$–$C_8$alkyl) amino, —$(CH_2)_q$—$NR_4$—$(CH_2)_q$—, wherein $R_4$ has the meaning recited above, and q is 1, 2, 3 or 4; or a 1,2-cyclohexylene radical of the formula:

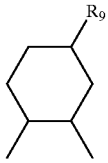

or a 1,2-aryl radical of formula

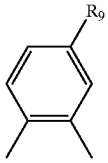

wherein $R_9$ is hydrogen, $SO_3H$, $CH_2OH$ or $CH_2NH_2$,

R and $R_1$ are each independently of the other cyano, halogen, $OR_4$ or $COOR_4$, wherein $R_4$ has the meaning recited above, nitro, linear or branched $C_1$–$C_8$alkyl, linear or branched partially fluorinated or perfluorinated $C_1$–$C_8$alkyl, $NR_5R_6$, wherein $R_5$ and $R_6$ are identical or different and are each hydrogen or linear or branched $C_1$–$C_{12}$alkyl, or linear or branched $C_1$–$C_8$alkyl-$R_7$, wherein $R_7$ is $NH_2$, $OR_4$, $COOR_4$ or $NR_5R_6$, which have the meanings given above, or —$CH_2$—N⊕$R_4R_6R_7$ or —N⊕$R_4R_5R_6$, wherein $R_4$, $R_5$ and $R_6$ have the meanings recited above, $R_2$ and $R_3$ are each independently of the other hydrogen, linear or branched $C_1$–$C_4$alkyl or unsubstituted aryl, or aryl which is substituted by cyano, halogen, $OR_4$ or $COOR_4$, wherein $R_4$ is hydrogen or linear or branched $C_1$–$C_4$alkyl, by nitro, linear or branched $C_1$–$C_8$alkyl, $NHR_5$or $NR_5R_6$, wherein $R_5$ and $R_6$ are identical or different and are each hydrogen or linear or branched $C_1$–$C_{12}$alkyl, or by linear or branched $C_1$–$C_8$alkyl-$R_7$, wherein $R_7$is $NH_2$, $OR_4$, $COOR_4$ or $NR_5R_6$, which have the meanings given above, or by —N⊕$R_4R_5R_6$, wherein $R_4$, $R_5$ and $R_6$ have the meanings given above wherein said liquor is then contacted with a surface to be cleaned.

2. A process according to claim 1, which comprises adding to the washing and cleaning liquor 5 to 350 μmol per litre of washing liquor of a compound of formula (1) or (2).

3. A process according to claim 1, which comprises adding to the washing and cleaning liquor 10 to 250 μmol per litre of washing liquor of a compound of formula (1) or (2).

4. A process according to claim 1, which comprises adding a compound of formula (1) or (2), wherein Y is a radical of the formula —$(CH_2)_r$—, wherein r is an integer from 1 to 8, or of the formula —$C(R_4)_2$—$(CH_2)_p$—$C(R_4)_2$—, wherein p is a number from 0 to 6, and the $R_4$ groups are each independently of one another hydrogen or $C_1$–$C_4$alkyl, or a 1,2-cyclohexylene radical or a 1,2-phenylene radical of formula:

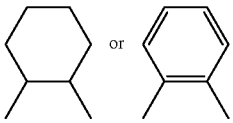

5. A process according to claim 1, which comprises adding a compound of formula (1) or (2), wherein R and $R_1$ are hydrogen, $OR_4$, $COOR_4$, $N(R_4)_2$ or N⊕$(R_4)_3$, wherein the $R_4$ groups in $N(R_4)_2$ or N⊕$(R_4)_3$ may be different and are hydrogen or $C_1$–$C_4$alkyl.

6. A process according to claim 5, wherein the $R_4$ groups in $N(R_4)_2$ or N⊕$(R_4)_3$ may be different and are hydrogen, methyl, ethyl or isopropyl.

7. A process according to claim 1, which comprises adding a compound of formula (1) or (2), wherein $R_2$ and $R_3$ are hydrogen, methyl, ethyl or unsubstituted phenyl.

8. A process according to claim 1, which comprises adding a compound of formula (2), wherein each $R_8$ is hydrogen.

9. A process according to claim 1, which comprises adding a compound of formula (1a)

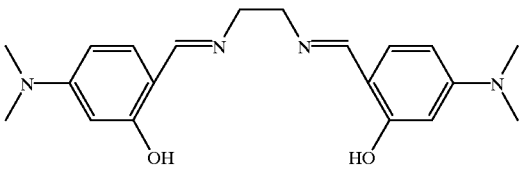

-continued
(1b)
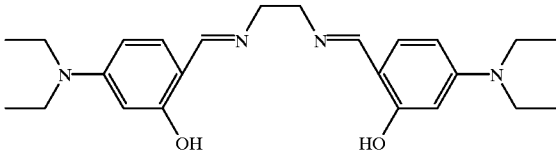
(1c)
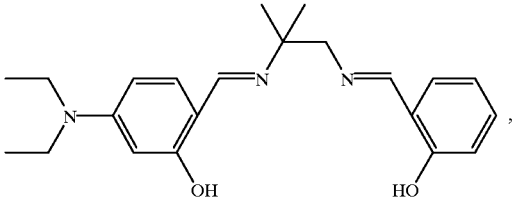
(1d)
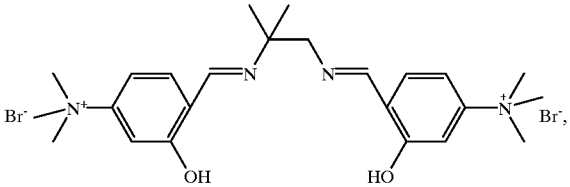
(1e)
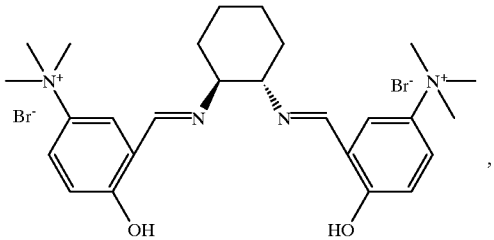
(1f)
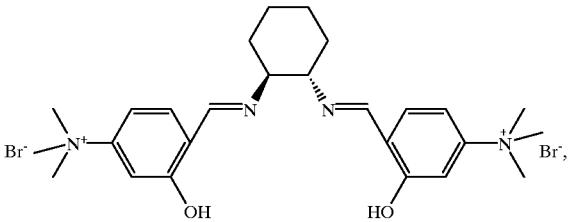
(1g)
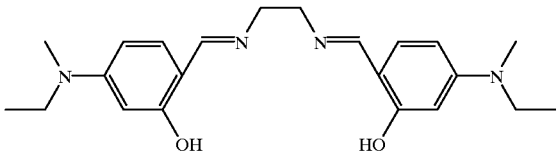
(1h)
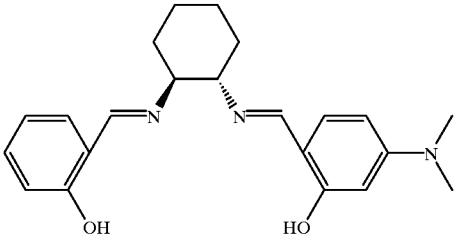
-continued
(1i)
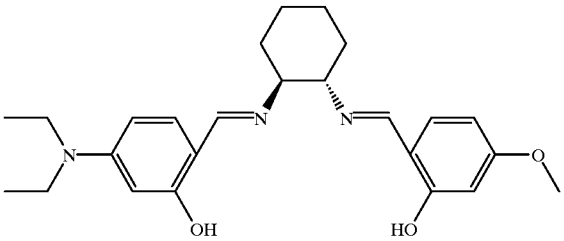
(1j)
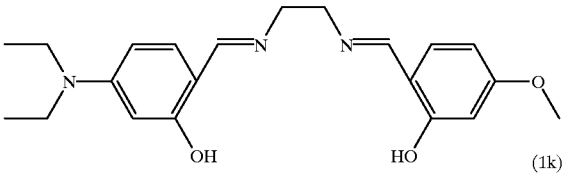
(1k)
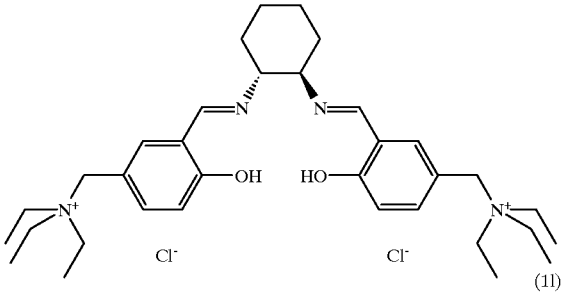
(1l)
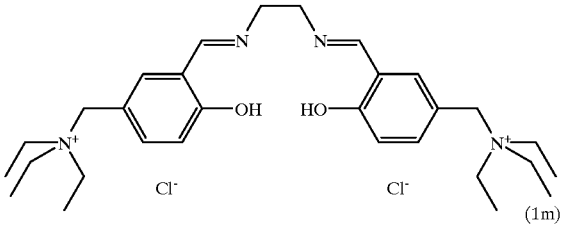
(1m)
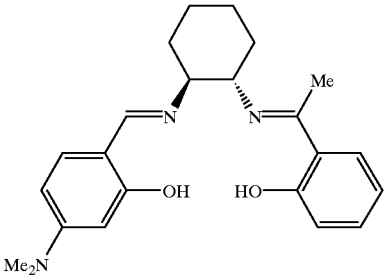
(1n)
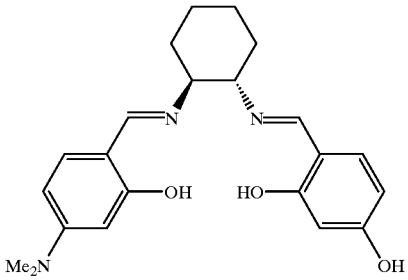

-continued (1o)

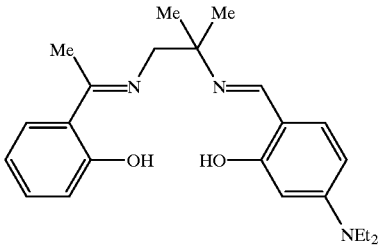

or (1p)

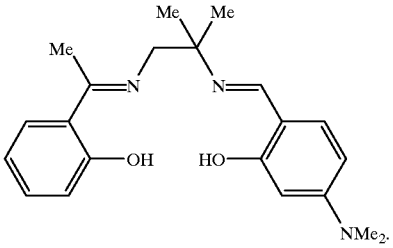

10. A washing and cleaning agent, which comprises

I) 5–90% A) of an anionic surfactant and/or B) of a nonionic surfactant,

II) 5–70% C) of a builder substance,

III) 0.1–30% D) of a peroxide, and

IV) a compound of formula (1) or (2) as defined in claim 1 in an amount which in a washing or cleaning process results in a 1–500 $\mu$molar solution.

11. A washing and cleaning agent, which comprises

I) 5–70% A) of an anionic surfactant and/or B) of a nonionic surfactant,

II) 5–50% C) of a builder substance,

III) 0.1–12% D) of a peroxide, and

IV) a compound of formula (1) or (2) as defined in claim 1 in an amount which in a washing or cleaning process results in a 5–350 $\mu$molar solution.

12. A washing agent according to claim 10, which additionally comprises 0.05 to 5% by weight of tetraacetylethylenediamine.

* * * * *